US010590753B2

(12) United States Patent
Parker

(10) Patent No.: US 10,590,753 B2
(45) Date of Patent: Mar. 17, 2020

(54) DOWNHOLE TOOL

(71) Applicant: Dale Parker, Rockingham (AU)

(72) Inventor: Dale Parker, Rockingham (AU)

( * ) Notice: Subject to any disclaimer, the term of this patent is extended or adjusted under 35 U.S.C. 154(b) by 126 days.

(21) Appl. No.: 15/310,187

(22) PCT Filed: May 12, 2015

(86) PCT No.: PCT/AU2015/000276
§ 371 (c)(1),
(2) Date: Nov. 10, 2016

(87) PCT Pub. No.: WO2015/172179
PCT Pub. Date: Nov. 19, 2015

(65) Prior Publication Data

US 2017/0260844 A1 Sep. 14, 2017

(30) Foreign Application Priority Data

May 12, 2014 (AU) ..... 2014901783

(51) Int. Cl.

| | |
|---|---|
| ***E21B 47/002*** | (2012.01) |
| ***E21B 47/00*** | (2012.01) |
| ***E21B 47/01*** | (2012.01) |
| ***E21B 27/00*** | (2006.01) |
| ***E21B 34/06*** | (2006.01) |
| ***E21B 37/00*** | (2006.01) |

(52) U.S. Cl.
CPC ..... *E21B 47/0002* (2013.01); *E21B 27/00* (2013.01); *E21B 34/06* (2013.01); *E21B 37/00* (2013.01); *E21B 47/011* (2013.01)

(58) Field of Classification Search
CPC ..... E21B 10/38; E21B 31/03; E21B 37/08; E21B 47/01; E21B 47/0002; E21B 21/103
See application file for complete search history.

(56) References Cited

U.S. PATENT DOCUMENTS

| | | | | |
|---|---|---|---|---|
| 1,790,678 A * | 2/1931 | Reinhold | E21B 47/0002 | 166/113 |
| 1,944,434 A * | 1/1934 | Keeler | E21B 27/00 | 166/102 |
| 1,964,264 A * | 6/1934 | Mack | E21B 37/08 | 137/454.4 |
| 2,737,864 A * | 3/1956 | Gutterman | G03B 17/245 | 33/314 |

(Continued)

OTHER PUBLICATIONS

International Preliminary Report on Patentability in PCT/AU2015/000276, dated Jun. 2, 2016, 4 pages.

(Continued)

*Primary Examiner* — D. Andrews
(74) *Attorney, Agent, or Firm* — Servilla Whitney LLC

(57) ABSTRACT

A survey tool for attachment to a drill string for inserting the survey tool into a borehole, the survey tool comprising a housing having a proximal end adapted for attachment to the drill string and a bore traversing the housing adapted to receive fluid from the drill string, and a piston adapted to be received within the bore, the piston being adapted to be selectively displaced between at least a first condition and a second condition, wherein in the first condition the fluid exists the housing at a first location and in the second condition the fluid exists the housing at a second location.

24 Claims, 10 Drawing Sheets

(56) References Cited

U.S. PATENT DOCUMENTS

| | | | | |
|---|---|---|---|---|
| 2,912,495 | A | 11/1959 | Moon | |
| 4,905,775 | A * | 3/1990 | Warren | E21B 4/003 137/504 |
| 4,938,060 | A | 7/1990 | Sizer | |
| 5,275,038 | A | 1/1994 | Sizer | |
| 2015/0007983 | A1 | 1/2015 | Tjhang | |
| 2015/0337633 | A1 * | 11/2015 | Legrand | E21B 47/011 166/276 |

OTHER PUBLICATIONS

International Search Report in PCT/AU2015/000276, dated Jun. 19, 2015, 5 pages.
Response to Written Opinion in PCT/AU2015/000276, dated Apr. 18, 2016, 2 pages.
Written Opinion of the International Searching Authority in PCT/AU2015/000276, dated Jun. 19, 2015, 4 pages.

* cited by examiner

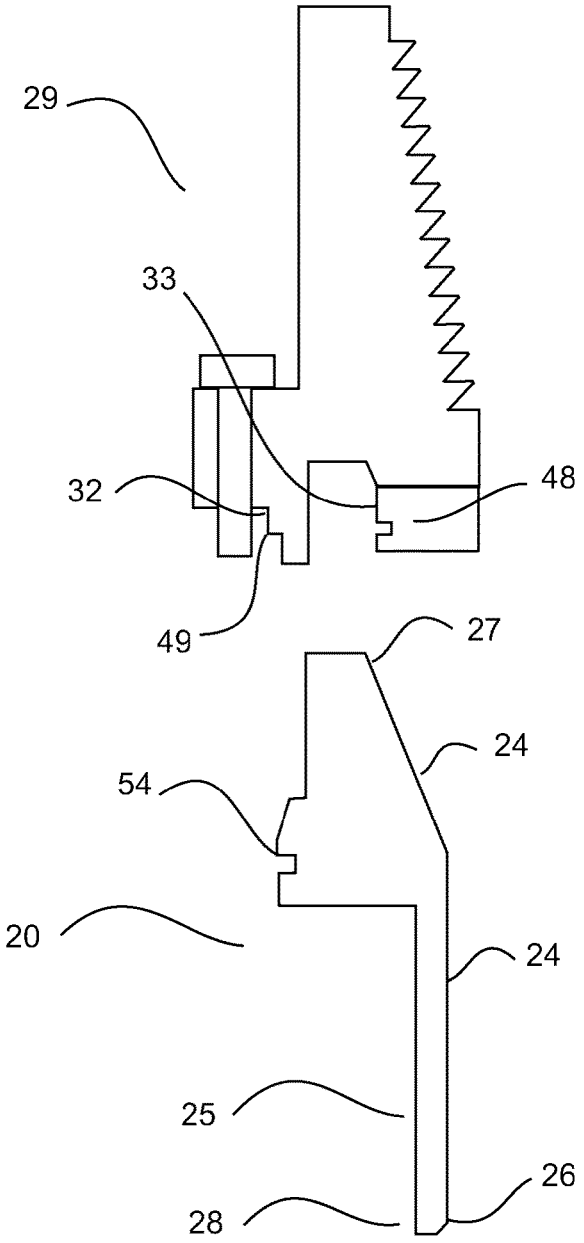
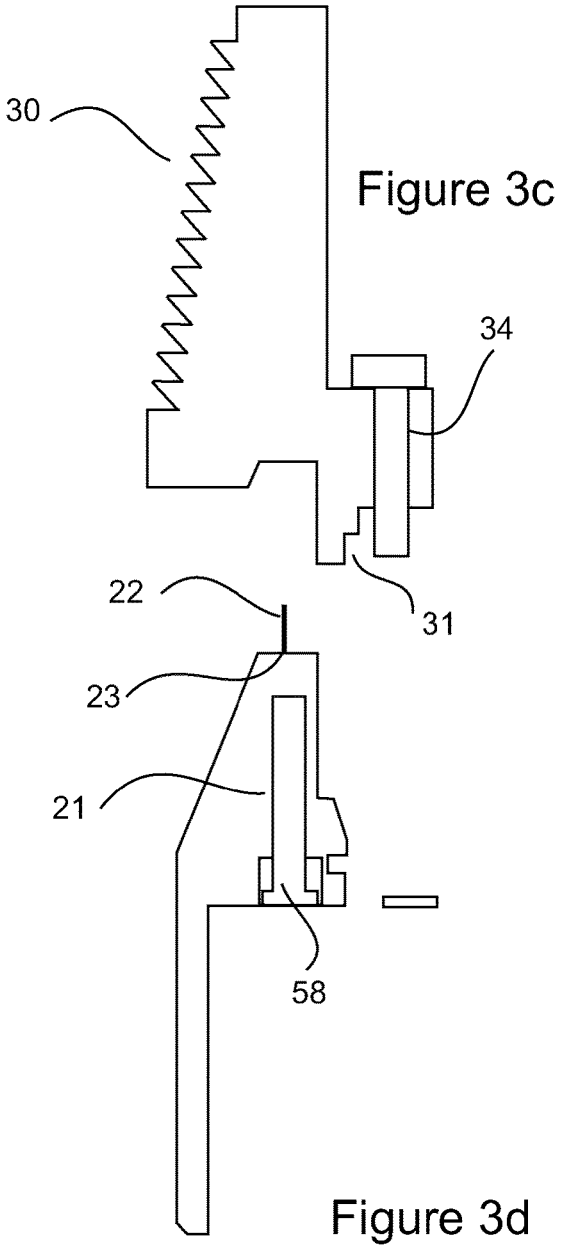
Figure 3c
Figure 3d

DOWNHOLE TOOL

CROSS REFERENCE TO RELATED APPLICATIONS

This is a National Phase entry of International Application No. PCT/AU2015/000276, filed May 12, 2015, which claims priority to Australian Application No. 2014901783, filed May 12, 2014, the disclosures of which are incorporated herein by reference in their entireties.

TECHNICAL FIELD

The present invention relates to survey tools for boreholes.

The invention has been devised particularly, although not necessarily solely, in relation to tools for surveying wells and, in particular, to downhole survey tools including cleaning tools and cameras.

BACKGROUND ART

The following discussion of the background art is intended to facilitate an understanding of the present invention only. The discussion is not an acknowledgement or admission that any of the material referred to is or was part of the common general knowledge as at the priority date of the application.

Blowouts of wells (also referred to us kicks) may lead to catastrophic events. An example of such an event is the British Petroleum's environmental catastrophe that occurred in 20 Apr. 2010.

A well blowout is an uncontrolled release of hydrocarbons from a well. Typically, blowouts occur after a failure of the pressure control systems contained in the well.

Currently, wells include Blowout preventers (BOP) to avoid blowouts. A BOP controls the pressure within the well and the flow of hydrocarbon as well as avoids tools and drilling parts from being ejected out of the wells.

It is essential that routine testing be undertaken of the interior of the well and, in particular, of the BOP. For example, the BOP includes shears and packing seals that may be caked with debris such as mud, cement or metallic residue. This may render the BOP inoperative. Regular inspection and cleaning of these seals is essential to ensure proper functioning of the BOP.

The routine testing includes a visual inspection of the equipment included in the well and, in particular, of the BOP. One of the reasons that visual inspection is undertaken is to be able to visualise the location and configuration of the debris. Visualising the location of the debris and its configuration permits applying a cleaning process at the particular location where the debris is located. This makes the cleaning process more efficient.

A particular disadvantage of conventional survey tools is that the inspection and cleaning process using these conventional tools is cumbersome and time consuming. This is particularly true because the process requires use a multitude of drill string tools that need to deployed into the well separately. As an example, typically, at first instance a jet cleaning tool is deployed into the riser. This tool cleans the interior of the well and in particular the BOP. After completion of this particular cleaning process, the jet cleaning tool is removed from the well and a conventional downhole camera is inserted into the well for inspection of the interior of the well and its equipment.

Unfortunately, on many occasions, the cleaning process, conducted by the cleaning tool, might not have properly removed all the debris; under these circumstances, the interior of the well needs to be further cleaned using the jet cleaning tool. For this, the survey tool needs to be pulled out of the well for redeployment of the cleaning tool into the well for further cleaning of the well. This adds additional costs to the drilling campaign.

Currently, there are survey tools that incorporate an outlet for discharging cleaning fluid into the well. This allows some portion of the debris to be removed before inspection of the interior of the well and of the equipment located in the well.

However, the discharging of the fluid is not sufficient for properly cleaning the interior of the well and the equipment located therein. Currently, proper cleaning can only conducted using a jet cleaning tool.

It is against this background that the present invention has been developed.

SUMMARY OF INVENTION

According to a first aspect of the invention there is provided a survey tool for attachment to a drill string for inserting the survey tool into a borehole, the survey tool comprising a housing having a proximal end adapted for attachment to the drill string and a bore traversing the housing adapted to receive fluid from the drill string, and a piston adapted to be received within the bore, the piston being adapted to be selectively displaced between at least a first condition and a second condition, wherein in the first condition the fluid exists the housing at a first location and in the second condition the fluid exists the housing at a second location.

Preferably, the piston is adapted to be displaced selectively between the first condition, the second condition and a further third condition.

Preferably, the third condition the fluid exists the housing at a third location permitting fluid to exit the housing to flush the borehole.

Preferably, the first location comprising sides of the housing permitting fluid to exit the housing for pressure jetting of side walls of the borehole or equipment contained in the borehole.

Preferably, the second location comprises a location at a distal end of the housing.

Preferably, the distal end of the housing is adapted to receive a camera.

Preferably, the second location is adjacent the distal end for delivering the fluid to the camera for cleaning and/or cooling thereof.

Preferably, the housing comprises a plurality of set of openings to allow fluid to exit the housing.

Preferably, the housing comprises a first set of high pressure jetting passages, the passages traversing the sides of the housing to allow pressure jetting of the side walls of the borehole or equipment contained in the borehole.

Preferably, the housing comprises a second set of front jetting passages, the passages traversing the distal end of the housing to allow cleaning and/or cooling of the camera.

Preferably, the housing comprises a third set of high volume passages, the passages traversing the housing to allow flushing of the borehole.

Preferably, the piston when in the first location allows fluid exiting the housing through the high pressure jetting passages, and the piston blocks fluid from flowing through the front jetting passages and through the high volume passages.

Preferably, the piston when in the second location allows fluid exiting the housing through the front jetting passages, and the piston blocks fluid from flowing through the high volume passages and through the high pressure jetting passages.

A survey tool according to any one of claims 11 to 13 wherein the piston when in the third location allows fluid exiting the housing through the high volume passages, and the piston blocks fluid from flowing through the front jetting passages and through the high pressure jetting passages.

Preferably, the housing and the piston is adapted to define a pressure chamber within the bore of the housing for containment of the fluid of the drill string.

Preferably, the pressure chamber comprises an upper pressure chamber, the upper pressure chamber being defined when the piston is located in the first location.

Preferably, the pressure chamber further comprises an lower pressure chamber, the lower pressure chamber being defined when the piston is located in the second and third locations.

Preferably, the piston is operatively connected to at least one actuator for movement of the piston along the longitudinal axis of the housing.

Preferably, the actuator comprises an electric motor comprising a spindle drive worm shaft operatively connected to the piston for movement of the piston along the longitudinal axis of the housing.

Preferably, the actuator comprises an upper and lower chamber adapted to move the piston, the upper and lower chamber being adapted to selectively receive hydraulic fluid for movement of the piston, the upper chamber receiving hydraulic fluid for moving of the piston to the distal end of the housing, and the lower chamber receiving hydraulic fluid for moving the piston to the proximal end of the housing.

Preferably, the hydraulic fluid is driven by a hydraulic pump fluidly connected to the upper and lower chamber, the pump driven by an electric motor.

Preferably, the electric motor and the hydraulic pump are located inside the piston.

Preferably, the electric motor and the hydraulic pump are located on the drill string.

Preferably, the actuator comprises an electric motor operatively connected to a distal end of the piston for selectively moving the piston along the longitudinal axis of the housing between the first, second and third locations.

Preferably, the actuator comprises an electric motor operatively connected to a distal end of the piston for selectively rotating the piston along the longitudinal axis of the housing between the first, second and third locations.

Preferably, the piston comprises a bore for receiving the fluid.

Preferably, the piston comprises a plurality of openings to allow fluid to exit the housing when the piston are located in either the first, second and fourth conditions.

Preferably, there are first, second and third set of openings.

Preferably, the first set of opening are located on the piston at first locations such the first set of openings fluidly communicate with the high pressure jetting passages of the housing when the piston is located in the first location.

Preferably, the second set of openings are located on the piston at second locations such that the second set of openings fluidly communicate with the front jetting passages of the housing when the piston is located in the second location.

Preferably, the third set of openings are located on the piston at third locations such that the third set of openings fluidly communicate with the high volume passages of the housing when the piston is located in the third location.

Preferably, the survey tool further comprises an outer sleeve comprising outlets being fluidly communicated with the plurality of set of passages of the housing to allow passage of the fluid through the outlets of the outer sleeve.

Preferably, the first set of high pressure jetting passages comprises high pressure filter nozzles for filtering of the fluid.

Preferably, the survey tool further comprising electric energy source adapted to being electrically connected to an electric motor and a camera.

Preferably, the energy source comprises a battery adapted to be received by the housing.

Preferably, the proximal end of the housing comprises a one way flip flap valve.

Preferably, the proximal end of the housing comprises a one way flap pup.

Preferably, the distal end of the housing comprises a basket adapted to collect debris.

According to a second aspect of the invention there is provided a drill string comprising a survey tool in accordance with any one the preceding claims.

According to a third aspect of the invention there is provided downhole camera comprising the survey tool in any one claims of the preceding claims.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which:

FIGS. 3*c* and 3*d* are exploded cross-sectional views of the cap and the piston of the survey tool shown in FIG. 1;

It should be noted that the FIGS. 1 to 9 are schematic only.

DESCRIPTION OF EMBODIMENT(S)

Figure 1:
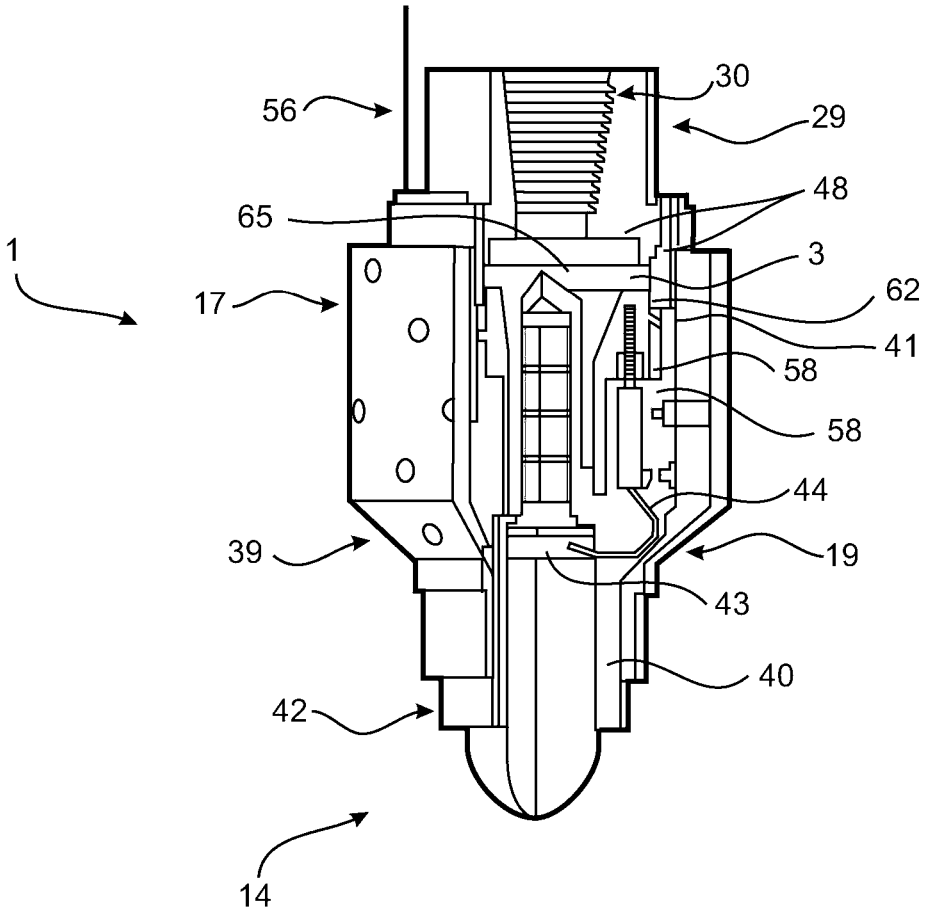
FIG. 1 is a perspective view of a survey tool in accordance with a first embodiment of the invention.

FIG. 1 is a schematic view of a survey tool 1 in accordance with the first embodiment of the invention.

The survey tool 1 is adapted to be mounted on a drill string for deployment of the survey tool into a borehole such as a well. The survey tool 1 shown in the figures comprises a camera and a cleaning tool.

The camera 14 is adapted to provide a real-time viewing with 360 degree continuous rotation with 110 tilt camera and a 10× optical and 40× digital zoom. LED lighting is also provided for illuminating the areas to be cleaned and inspected.

The particular arrangement of the survey tool 1 of FIG. 1 may operate in three different cleaning modes.

A first cleaning mode comprises forward facing jetting nozzles for cleaning mainly the camera 14. In particular, this mode mainly cleans the lens of the camera and breaks up any debris located in front of the camera.

A second cleaning mode allows for high volume fluid flushing to clean the area to be inspected. This ensures high quality viewing of the zone of interest.

A third cleaning mode allows for cleaning, for example, the internal parts of the inner BOP surfaces, in particular, it allows for cleaning of thread, seals, casing and tubing hangers, and hydraulic coupling. This cleaning mode comprises side jet cleaning.

The survey tool 1 is particular advantageous because it allows the cleaning process of the well and the viewing process of the well to be conducted using a single tool.

Moreover, the first, second and third cleaning modes of the survey tool 1 can be continuously repeated to ensure that all debris is properly removed from the cavities of the BOP. The sequence in which the particular cleaning modes are selected may also varied as required.

The cleaning modes may be changed through activation of a piston 20 that moves relative to the housing 2 of the survey tool 1. By moving the piston 20, it is possible to select the type of cleaning mode to be conducted by the survey tool 1. Selection of the type of cleaning mode the will be conducted as well as when viewing or capturing of images should occur can be controlled from a distal location of the survey tool. For example, an operator located at the drilling rig may control the survey tool 1.

Figure 2:
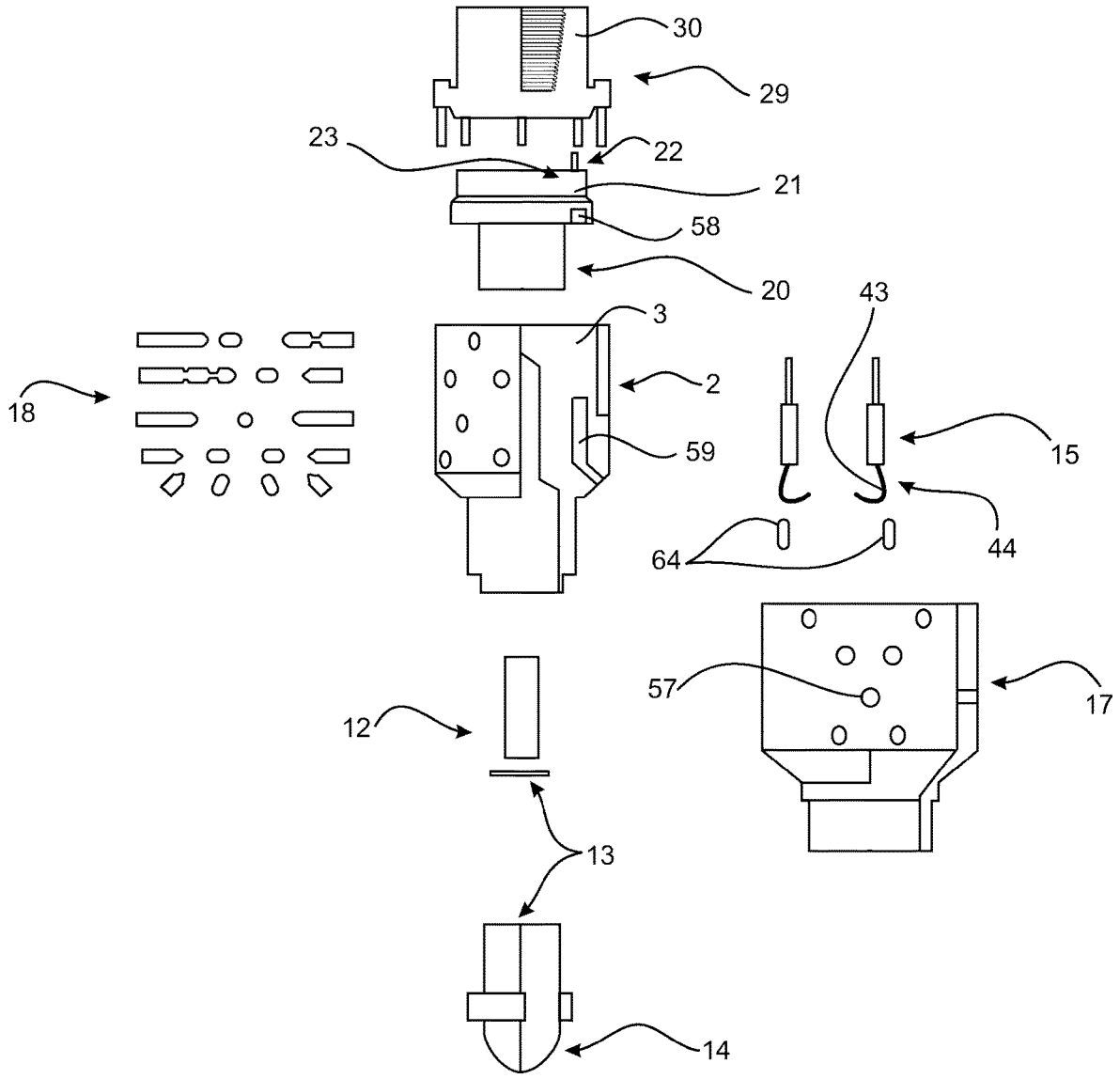
FIG. 2 is an exploded view of the survey tool shown in FIG. 1.

We refer now to FIG. 2. FIG. 2 shows an exploded view of the survey tool 1 shown in FIG. 1.

As shown in FIG. 2, the survey tool 1 comprises a main body 2 and a cap 29. The cap 29 comprises an upper threaded end 30 adapted to be attached to the distal end of a drill string and a lower end for attachment to the main body 2. The main body 12 comprises a plastic cover 17 adapted to receive the main body 1.

The cap 29 comprises an open end adapted to receive the fluid for delivery into the main body 2 of the survey tool 1 for conducting the cleaning process.

The survey tool 1 comprises a piston 20 adapted to be received by the upper open end of the main body 12. The piston 20 is adapted to slide within the main body 2 along the longitudinal axis of the survey tool 1. Sliding of the piston 20 within the main allows selection of the first, second and third cleaning modes of the survey tool 1.

Further, the survey tool 1 comprises electric motors 15. The electric motors 15 are operably connected to the piston 20 to slide the piston 20 within the main body 2.

The electric motors 15 comprise cords 44 for electrically connecting the motors 15 to batteries 12. The batteries 12 are included in a battery housing having an inner wall 8 (see FIGS. 3*a* and 3*b*). The housing is slideably received by the lower end of the main body 2.

Furthermore, a camera 14 is adapted to be attached to the lower end of the main body. The camera 14 is operatively connected to the batteries 12. The camera 14 comprises a lens. The lens is located at the lower end of the main body 2 distal to the cap 29.

As mentioned earlier, the piston 20 is adapted to selectively slide between an upper location of the main body 2 and a lower location of the main body 2.

The main body 2 comprises a plurality of passages. The passages traverse the walls of the main body longitudinally and transversally. The passages permit flow of fluid through the main body via outlets traversing the housing of the main body.

As mentioned before, the main body comprises an outer sleeve 17. The outer sleeve 17 comprises outlets 57 that match with the outlets of the passages of the main body 2 to allow passage of the fluid through the outer sleeve 17.

The purpose of the passages traversing the main body 1 will become apparent from the descriptions below.

As mentioned before, the survey tool 1 is adapted to provide three cleaning modes which can be selectively chosen by the operator of the survey tool 1. Selection of the particular cleaning mode is possible due to the presence of different type of set of passage. One set of passages allows conducting the first cleaning mode; another set of passages allows conducting the second cleaning mode; and a further set of passages allows conducting the third cleaning mode.

Figure 3:
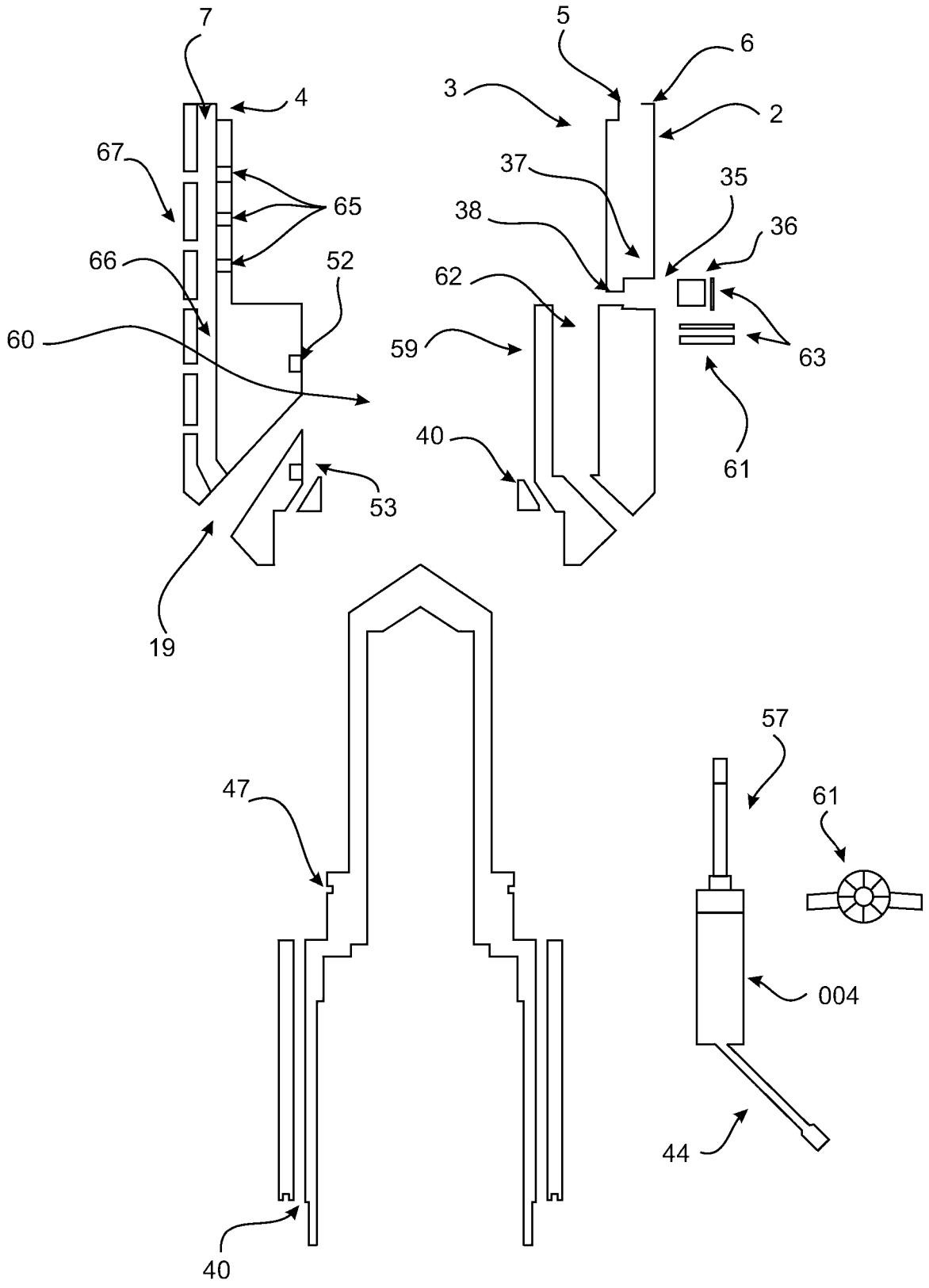
FIG. 3 is a cross-sectional exploded view of the main body and of battery housing and the electric motor of the survey tool shown in FIG. 1.

In particular, the first cleaning mode is selected by allowing fluid to exit passages 40 (referred to herein as front jetting passages)—see FIG. 1; the second cleaning mode is selected by allowing fluid to exit passages 19 (referred to herein as high volume flushing outlets)—see FIG. 1; the third cleaning mode is selected by allowing fluid to exit passages 65 (referred to herein as high pressure jetting passages)—see FIG. 3.

The selection of the particular set of passages 19, 40 and 65 is accomplished by valve means. The valve means allows diversion of the fluid into the particular set of passages for selecting a particular cleaning mode.

In accordance with the first embodiment of the invention, the valve means comprise the piston 20 that is adapted to move relative to the housing of the main body 2.

As mentioned earlier, the piston 20 is adapted to be slideably received by the main body 2. And, the cap 29 is adapted to be mounted onto the main body 2 defining a pressure accumulation chamber. The piston 20 has a smaller outer wall diameter 25 permitting the piston 20 to be lowered into the lower housing valve body wall 59, defining a first divisional chamber 3 and a second divisional chamber 60.

The hollow piston 20 is moveable relative to the housing valve body 2 so as thereby controlling the flow of fluid within the housing 2. In particular, movement of the piston 20 along the longitudinal axis of the main body 2 allows diverting the fluid through the particular set of passages.

The cap 29 comprises a bore that permits fluid flowing from the drilling rig (or an intervention vessel) to flow down the drillstring into the pressure accumulation dispersion chamber. This arrangement allows diverting the fluid into the set of particular passages 19, 40 and 65 depending on the type of cleaning mode that is desired. This is because depending on the particular location of the piston 20 along the longitudinal axis of the main body 2, the piston outer wall 25 blocks the entrance of a pair of passages, while the particular set of passages are left open permitting the fluid to flow through the particular open passages.

As an example, by lowering the piston 20, the piston 20 seals the lower housing valve body wall 59 (see FIG. 3). This prevents fluid from flowing past the high volume flushing outlet 19. As the piston 20 travel further down passed the high volume outlet depressing seals 53 (see FIG. 3) the piston 20 depresses seals 47 and seals off the forward jetting passages 40. As the piston 20 retracts into its lowest position, the piston 20 fully seals off the second divisional chamber 60.

At this location, the plurality of high pressure jetting passages 65 in the first expansion chamber 3 are open allowing fluid to flow through the plurality of high pressure jetting passages 65, then through a plurality of the high pressure longitudinally jetting passages 66, and out of the plurality of transvers jetting nozzle outlets 67. This allows side high pressure jetting. In a particular arrangement the outlets 67 may be adapted to receive a high pressure filter nozzle 18.

The piston 20 has an external piston seal 54 that seals between the external piston wall 25 and the first divisional chamber 3 stopping flow from the first divisional chamber 3 at the external piston seal 54.

The piston 20 is moved via actuators. The actuators comprise a gear box and an electric motor 15, spindle drive worm shaft 16, and spindle drive worm shaft nut 58 (see FIGS. 1 to 3). By design the electric motor 15 will have hall sensors built in for determining and providing the location of the piston along the longitudinal axis of the main body 2.

The motor 15 and the respective gear boxes are screwed and sealed into an elongated spindle gear retaining cap 61—see FIG. 3.

The spindle gear retaining cap 61 has seals for sealing between the inside of the spindle gear cap 61 and the electric motor 15. The motor 15 and the gear boxes are sealed into an elongated spindle gear retaining cap 61. The spindle gear retaining cap 61 is placed into passage 62 defined within the main body 2—see FIG. 3. The elongated cap 61 comprises a matching recess to accept the elongated cap 61 within the housing 62, the seals 51 seal the gap between the inside of the housing 62 and spindle gear retaining cap 61.

The motors 15, spindle drive and gear 16 and the spindle gear retaining cap 61 are inserted into an oil filed provision sealed within the housing 62. They are held in place by a circlip 63 (see FIG. 3) screwed or bolted in place. The spindle gear retaining cap 61 stops the motor 15 and the spindle gear assembly 16 from rotating inside the passage 62. The electric motor 15 comprise a power cable with water proofed connectors 43, gland packing nut and sealing grommet 64 for sealing around power lead 44.

The base of the piston 20 comprises a threaded gear nut assembly 58 for accepting the spindle shaft 16. On the upper portion of the piston 20 there is a passage 23 going through into the spindle gear passage 21—this is to allow for a tool like a screw driver or Allen key to be passed through. This tool access port 23 allows for manual manipulation of the spindle drive 16 for the manual removal of the piston 20. Access holes 23 will have a grub screw 22 inserted to seal off these passages 23.

Further, referring to FIG. 3, a particular arrangement of the housing of the main body 2 comprises a series of filter recesses 35 adapted to receive at least one filter 36 to be secured by a circlip 63 into the respective circlip retainer position 37. This allows for filtering of contaminated flowing fluid flowing through filters 36 from the outside of the housing. The filtered fluid may flow through the opening 38 of the filter 36 to the underside of the piston 20. This removes any vacuum formed under the piston 20 that may stop the piston 20 from moving. The filtering process will also remove any debris from the fluid avoiding jamming of any parts.

Figure 3A:
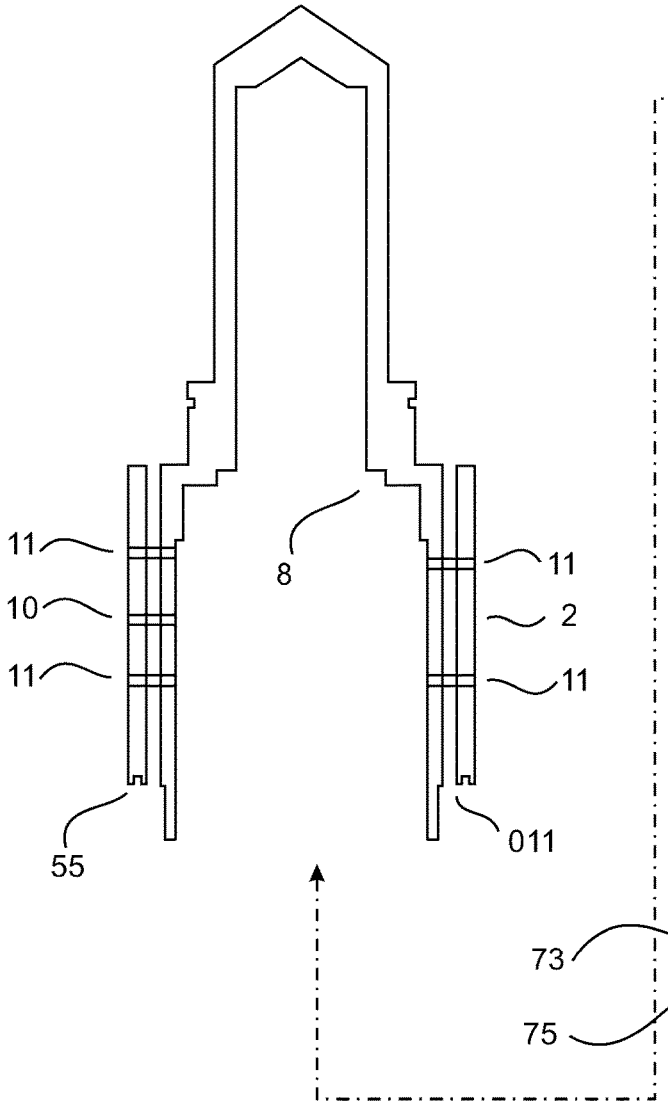
FIGS. 3*a* and 3*b* are exploded cross-sectional views of the camera and battery housing separated from the main housing of the survey tool shown in FIG. 1.
Figure 3B:
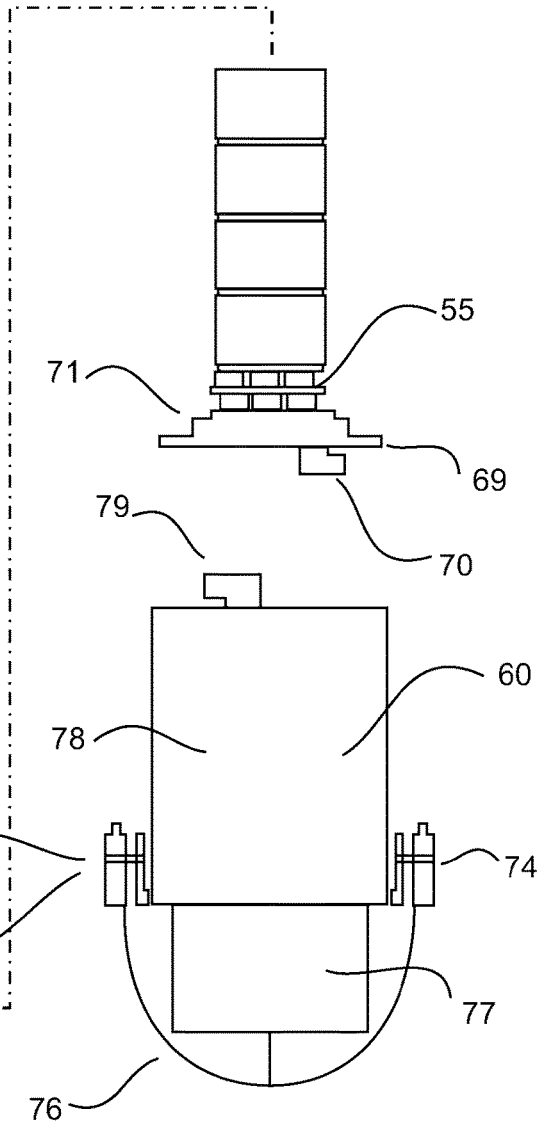

We refer now in particular to FIGS. 3*a* and 3*b*.

The electric motor 15 and camera 14 are electrically driven by a battery 12. FIGS. 3*a* and 3*b* show the battery 12, circuit board and camera 14.

The battery 12 comprises a cap 69 having water proof connector 70 for the purpose of allowing the control signals and power to transvers through the battery cap 69 but maintaining a water tight seal.

The shoulders on the battery cap 69 comprise a seal arrangement on the side wall 71. In this manner, a water tight seal is formed between the matching shoulder 8 of the battery housing.

The battery cap 60 comprises a plurality of longitudinal holes 72 (not depicted), around the circumference of the cap 60 to fasten the battery within the battery housing.

The camera 14 is electrically connected to the battery 12. For this an umbilical 56 is passed through an umbilical side port 10 of the camera housing. One end of the umbilical 56 is connected to the water tight connector 70 of the battery cap 69. The other end of the umbilical 56 is connected to a water tight connector on the camera base 79. The umbilical 56 runs between a machined recess in the plastic protection cover and a machined recess in the housing of the main body 2.

A camera retainer is mounted on the camera 14. The camera retainer and the forward flushing ports of the camera retaining housing 73 will line up with the corresponding forward flushing ports.

Figure 4A:
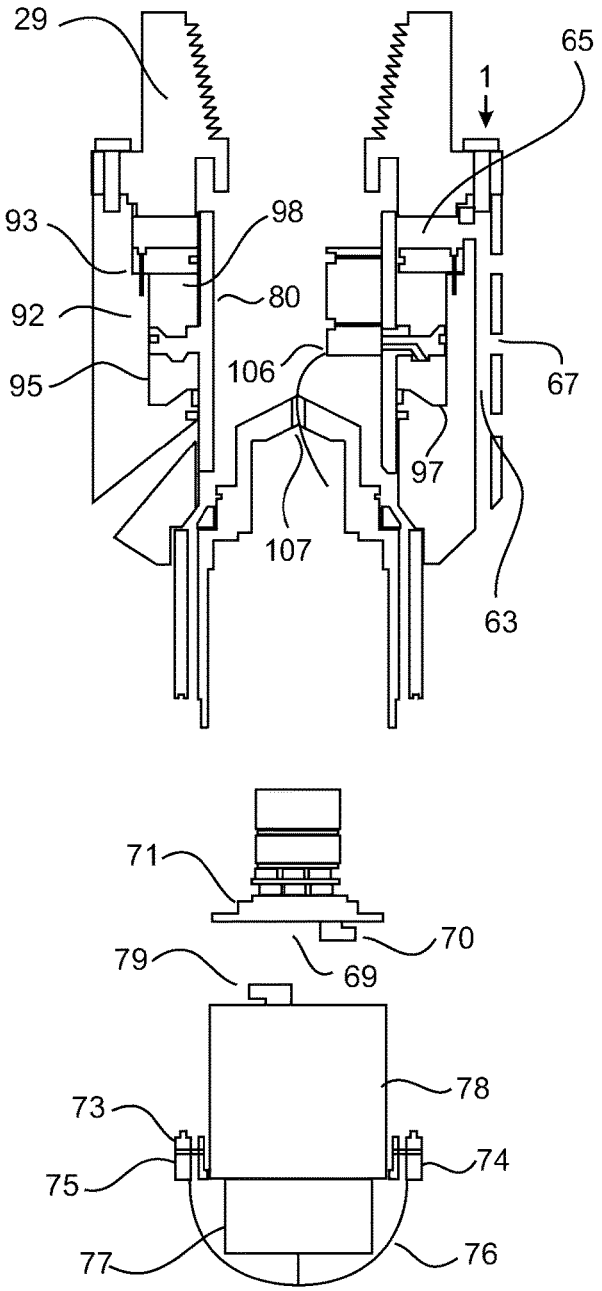
FIG. 4*a* is an exploded cross-sectional view of a survey tool in accordance with a second embodiment of the invention.
Figure 4B:
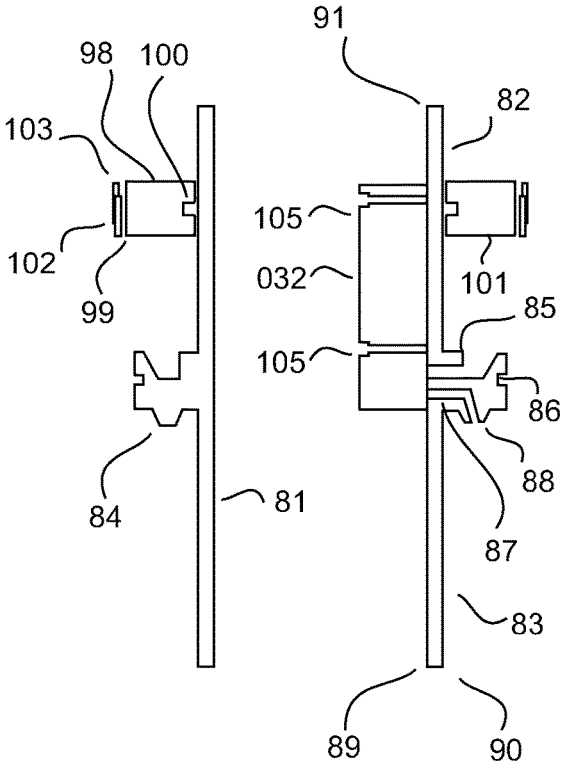
FIG. 4*b* is a cross-sectional view of the piston of the survey tool shown in FIG. 4*a;*

The camera retaining housing 73 will have a plurality of transverse camera retaining passages 74, the camera housing retaining grub screws 75 retain the camera housing and holding it tight against rubber seal 55. The camera retaining housing 73 comprises protective frame 76 preventing the camera from being damaged FIGS. 4*a* to 4*b* show an apparatus according to a second embodiment of the invention. The apparatus according to the second embodiment is similar to the apparatus according to the apparatus of the first embodiment and similar reference numerals are used to identify similar parts.

However, the second embodiment of the invention differs from the first embodiment of the invention in several features. For example, the second embodiment of the invention comprises an electric motor 032 for driving a hydraulic pump. The hydraulic fluid driven by the hydraulic pump moves the piston 80 along the longitudinal axis of the main body 2.

As mentioned before, movement of the piston 80 along the longitudinal axis allows selection of the particular cleaning mode. Selection of the particular cleaning mode is accomplished by opening a particular set of passages and blocking the remaining set of passages using the piston 20.

In this second embodiment, the piston 20 is driven by hydraulic fluid. In the particular arrangement shown in FIG. 4*b*, the inner wall of the main body 2 comprises a piston chamber 92. The upper end of the piston chamber 92 comprises a piston retainer 98.

The piston chamber 92 is sealed by a plurality of O-ring seals that are located on (1) the outer circumference of the piston retainer 98 and (2) a plurality of seals 100 located between the inner circumference of the piston retainer 98 and the outer piston wall 82—see FIG. 4*b*. The upper piston chamber 92 comprises a shoulder 93 for aligning with the underside of a shoulder 101 of the piston retainer 98.

The piston retainer 98 comprises a plurality of longitudinal passages bolt holes 103 allowing for bolts to pass through for securing the piston retainer 98 to the housing of the main body 2.

The hollow internal hydraulic pump piston 80 comprises a protrusion 84 and 86. The protrusions 84 and 86 divide the piston chamber 92 into a lower chamber 95 and an upper chamber 96.

The lower and upper chamber 95, 96 of the piston chamber 92 are sealed from each other by a plurality of O-ring seals which are located in a plurality of grooves in protrusions 84 and 86.

The upper chamber 96 and the lower chamber 95 are fluidly connected allowing fluid to flow from the upper chamber 96 into the lower chamber 95 for lifting of the piston 80. Fluid may also flow from the lower chamber 95 into the upper chamber 96 for lowering of the piston 80.

To allow fluid communication between the upper and lower chambers 96 and 95, the piston wall comprises a passage 85. The piston 80 also comprises a passage 87 having an extension tube 88 defined by a flange 87 facing latterly down. The tube 88 is adapted to keep the pickup in fluid.

The both upper and lower piston 96, 95 chambers are larger than required to accommodate for extra fluid supply removing the need for a fluid supply bottle.

The passages 85 and 88 are fluidly connected to a hydraulic pump electric motor 032. The pump 032 drives the hydraulic fluid between the upper and lower chambers 96 and 95 for displacing the piston 80 along the longitudinal axis of the main body 2

The electric hydraulic motor 104 is mounted on the inside of the piston 80 via bolts 105. The bolts 105 have the appropriate water tight sealing arrangements connecting the motor to the piston 80. An oil filled cable 106 is connected through the battery housing with a water tight connector. The battery housing comprises a water proof fitting 107.

As mentioned before, moving the piston 80 allows selecting the set of passages that will permit exit of the fluid from the survey tool for cleaning purposes. In the particular arrangement of the second embodiment, the fluid is transferred to the set of passages 67 via at least one passage 65 that traverse the main body 2 at a location adjacent the piston retainer 98. Fluid is provided to the set of passages 67 when the passages 67 are open. The passages 67 are in the open condition when the piston 80 has been lowered opening the passages 87. As is shown in FIG. 4, the passages 67 are in closed condition when the upper portion of the piston 80 blocks the passage 65.

Further, as shown in FIG. 4*a*, a channel 63 is defined in the main body 2 allowing fluid communication between the passage 65 and the inner bore of the main body 2 containing the fluid.

Figure 5A:
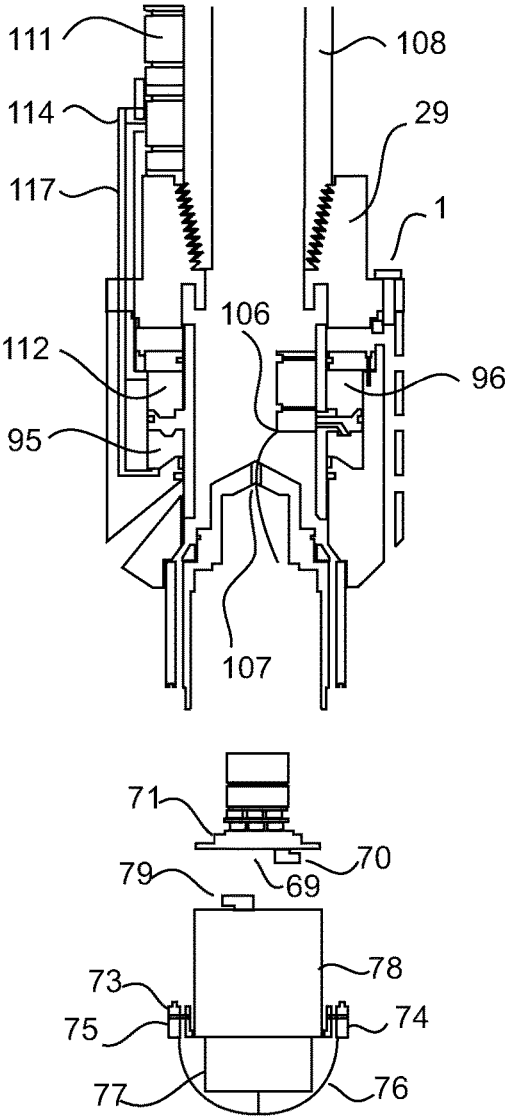
FIG. 5*a* is an exploded cross-sectional view of a survey tool in accordance with a third embodiment of the invention.
Figure 5B:
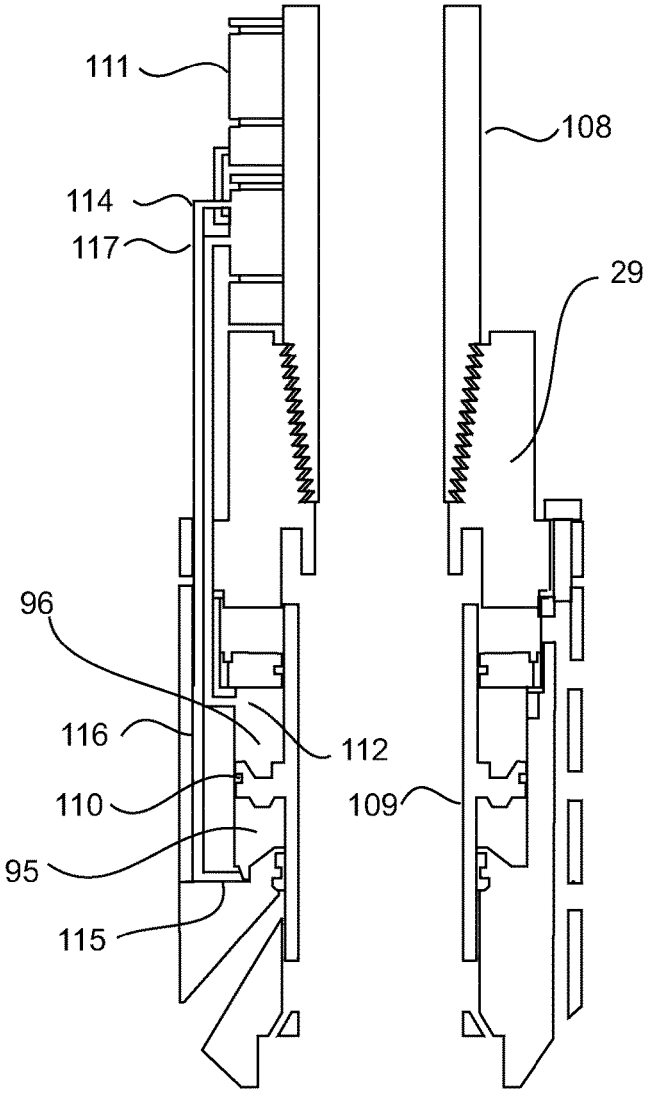
FIG. 5*b* is a cross-sectional view of the main body of the survey tool shown in FIG. 5*a;*

FIGS. 5*a* and 5*b* show an apparatus according to a third embodiment of the invention. The apparatus according to the third embodiment is similar to the apparatus according to the second embodiment and similar reference numerals are used to identify similar parts.

The third embodiment of the invention differs from the second embodiment of the invention in several features. For example, the second embodiment of the invention comprises an electric motor 111 (referred to as the motor 032 in the second embodiment of the invention) attached to the outer wall of the drill string 108—see FIG. 5*a*.

The electric motor 111 is substantially the same motor 032 of the second embodiment of the invention. The motor 111 is adapted to move hydraulic fluid between the upper chamber 96 and the lower chamber 95 for moving of the piston 80 along the longitudinal axis of the main body 2.

To allow fluid transport between the upper and lower chamber 96 and 95 there is provided a port 112 traversing the upper piston chamber 96. The port 112 is fluidly connected a longitudinal passage 113 going up through the cap 29) attached to a hydraulic tubing 114 that connected to the hydraulic motor 111.

Further, a port 115 is provided traversing the lower piston chamber 95 and fluidly connected to a longitudinal passage 116 (going up through the cap 29) and fluidly attached to a hydraulic tubing 117 connected to the hydraulic motor 111. A port 112 is provided traversing the upper piston chamber 96 and fluidly connected to a longitudinal passage 113 (going up through the cap 29) and fluidly attached to a hydraulic tubing 114 connected to the hydraulic motor 111.

Upward movement of the piston 109 (referred to as the piston 20 in the second embodiment of the invention) is accomplished by pumping hydraulic fluid into the lower piston chamber 95 through the port 115; lowering of the piston 109 is accomplished by pumping hydraulic fluid into the upper piston chamber 96 through the port 112.

The both upper and lower piston chambers 96, 95 are larger than required to accommodate for extra fluid supply removing the need for a fluid supply bottle.

Figure 6A:
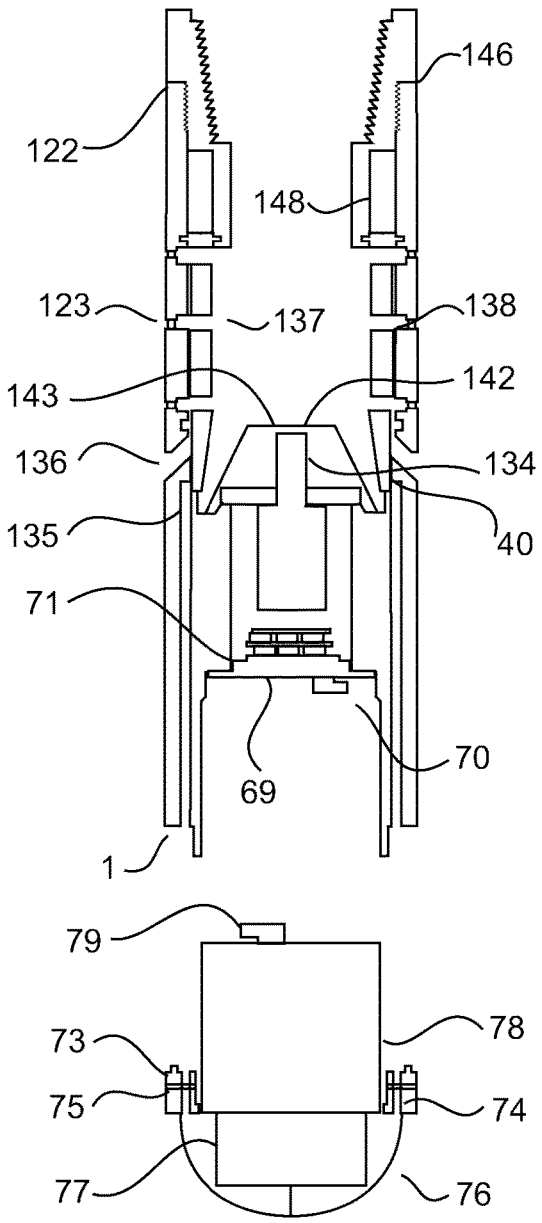
FIG. 6*a* is an exploded cross-sectional view of a survey tool in accordance with a fourth embodiment of the invention.
Figure 6B:
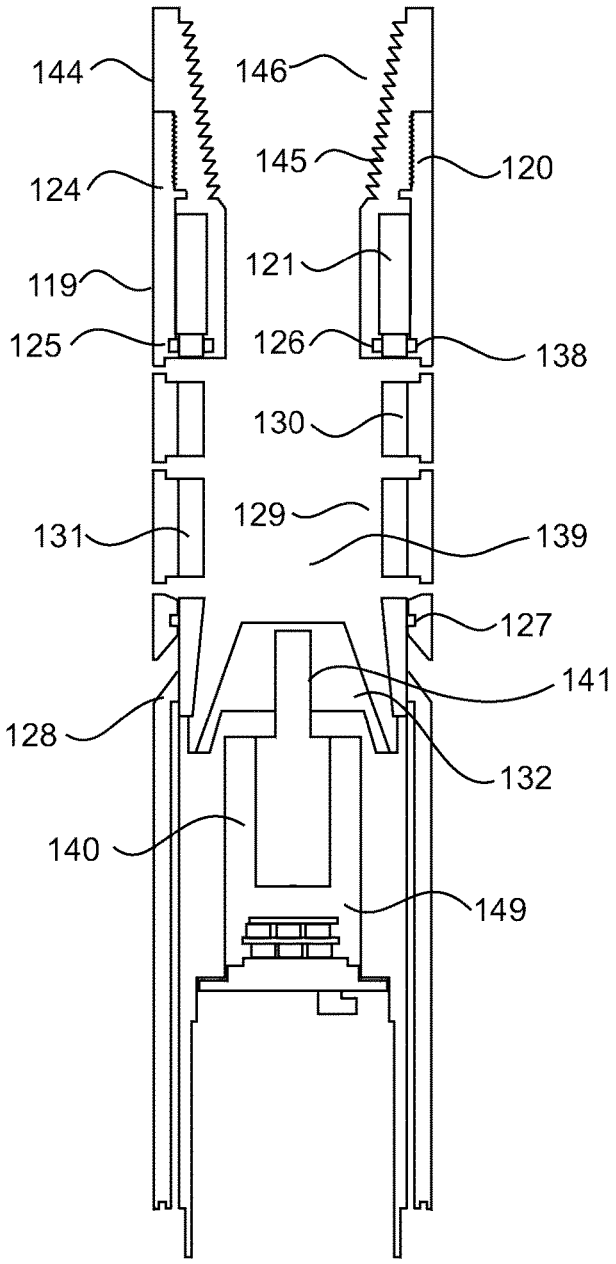
FIG. 6*b* is a cross-sectional view of the main body of the survey tool shown in FIG. 6*a;*

FIGS. 6*a* to 6*b* show an apparatus according to a fourth embodiment of the invention. The apparatus according to the fourth embodiment is similar to the apparatus according to the apparatus of the first embodiment and similar reference numerals are used to identify similar parts.

The third embodiment of the invention differs from the first embodiment of the invention in several features. For example, in accordance with the fourth embodiment of the invention the piston 80 (herein referred to as piston 129) moves along the longitudinal axis of the main body 2 (herein referred to main body 120) by action of an electric motor 140 operatively connected to the lower end of the piston 129.

In particular, the electric motor 140 is operatively connected to a gear box. The gear box allows for moving the piston 129 along the longitudinal axis of the main body 120. As mentioned earlier movement of the piston 129 allows selection of the particular cleaning mode to be used. The piston comprises a bore for receiving the fluid.

Referring to FIG. 6*b*, the survey tool 1 in accordance with the fourth embodiment of the invention comprises a cap 144 for attachment to the drill string (not shown) and to the main body 120. In this particular arrangement of the fourth embodiment, the lower end of the cap 144 has an outer thread 145 for attachment to the upper end of the main body 120.

The cap 144 comprises a seal 124 for sealing on the inside of the body wall 121, the cap 144 will have at least one shoulder 150 for aligning and retaining the cap 144 to the matching housing shoulders 122.

Further, the cap 144 has a passage that allows for the piston 129 slide along the longitudinal axis of the main body 120. There are provided a plurality of seals for sealing of the inside of piston 129 and the inside of the cap 146 and the outside of the piston 129 against the inside of the main body 121. A bleed passage 148 traversing through the main body 120 allows for pressure and vacuum release.

The piston 129 moves along the longitudinal axis of the main body 120 via an actuator. The actuator comprises the electric motor 140 together with the gear box and a spindle drive worm shaft 141. A spindle drive worm shaft nut in also incorporated.

Moving the piston 129 along the longitudinal axis allows selecting the particular cleaning mode to be used. This is because by moving the piston 129 particular passages may be blocked or opened to impede or allow fluid from exiting the survey tool 1 for cleaning purposes. For this, the piston 155 comprises a plurality of sets of passages (such as passages 137) allowing the fluid to flow out of the survey tool 1 when the set of passages 137 are in fluid communication with set of passages of the main body 151.

For example, as shown in FIG. 6*b*, the main body 120 comprises a plurality of set of passages 123, 136 and 40. Selection of the particular cleaning mode is possible due to the presence of the different type of set of passages 123, 136 and 40. One set of passages allows conducting the first cleaning mode; another set of passages allows conducting the second cleaning mode; and a further set of passages allows conducting the third cleaning mode. In particular, the first cleaning mode is selected by allowing fluid to exit passages 40 (referred to herein as front jetting passages)—see FIG. 6*a*; the second cleaning mode is selected by allowing fluid to exit passages 19 (referred to herein as high volume flushing outlets)—see FIG. 6*a*; the third cleaning mode is selected by allowing fluid to exit passages 123 (referred to herein as high pressure jetting passages)—see FIG. 6*a*.

The selection of the particular set of passages is accomplished by the movement of the piston 129. For this, the different sets of passages are located at different locations along the main body 120 with respect to each other. Locating each set passages at locations that differ from the location of the other set of passages allows selecting (by moving the piston 129) the particular set of passages that will permit flow of the fluid out of the main body 120 for cleaning purposes. The remaining set of passages do not permit fluid flow out of the main body 120 because they are blocked by the wall of the piston 129.

By design the electric motors 140 will have hall sensors for determining location of the piston 210. The electric motor 140 together with the gear box are screwed and sealed into the water tight battery compartment 149.

The lower end of piston 129 is operatively connected to the electric motor 140. For this the lower end of the piston 129 comprises a threaded gear nut assembly 133 for accepting the spindle shaft 141.

The fact that the piston 129 is operatively connected to the electric motor allows moving the piston 129 along the longitudinal axis of the main body 120. As was explained with reference to the first embodiment of the invention, moving of the piston 120 (or 80 as referred to in the descriptions of the first embodiment of the invention) allows selecting the particular cleaning mode to be used.

Figure 7A:
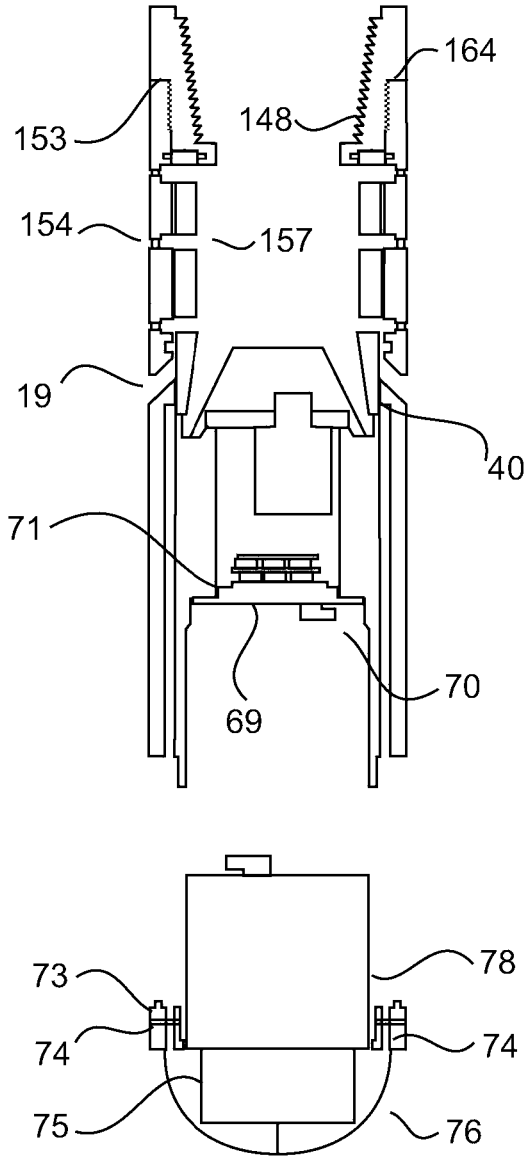
FIG. 7*a* is an exploded cross-sectional view of a survey tool in accordance with a fifth embodiment of the invention.
Figure 7B:
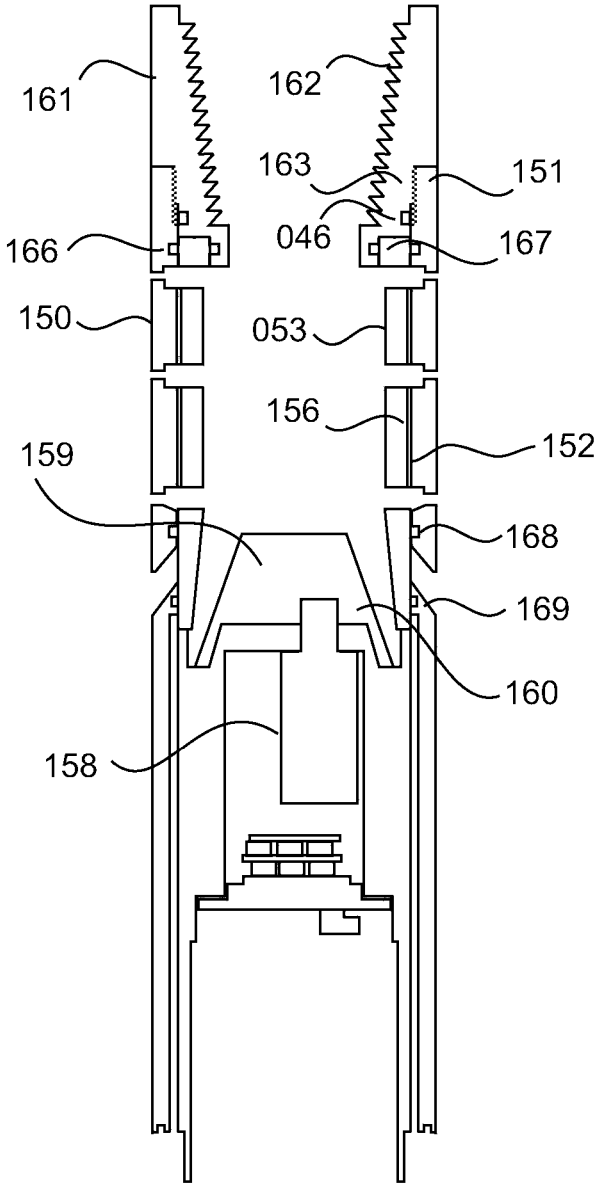
FIG. 7*b* is a cross-sectional view of the main body of the survey tool shown in FIG. 7*a;*

FIGS. 7*a* to 7*b* show an apparatus according to a fifth embodiment of the invention. The apparatus according to the fifth embodiment is similar to the apparatus according to the apparatus of the fourth embodiment and similar reference numerals are used to identify similar parts.

The fifth embodiment of the invention differs from the fourth embodiment of the invention in several features. For example, the fifth embodiment of the invention comprises a piston 155 (referred to as 129 in the fourth embodiment of the invention) that is adapted to rotate.

Rotation of the piston 155 around the longitudinal axis allows selecting the particular cleaning mode to be used. This is because by rotating the piston 155 particular passages may be blocked or opened to impede or allow fluid from exiting the survey tool 1 for cleaning purposes. For this, the piston 155 comprises a plurality of sets of passages (such as passages 157) allowing the fluid to flow out of the survey tool 1 when the set of passages 157 are in fluid communication with set of passages of the main body 151.

For example, as shown in FIG. 7*a*, the main body 152 comprises a plurality of set of passages 154, 19 and 40. Selection of the particular cleaning mode is possible due to the presence of the different type of set of passages 154, 19 and 40. One set of passages allows conducting the first cleaning mode; another set of passages allows conducting the second cleaning mode; and a further set of passages allows conducting the third cleaning mode. In particular, the first cleaning mode is selected by allowing fluid to exit passages 40 (referred to herein as front jetting passages)—see FIG. 7*a*; the second cleaning mode is selected by allowing fluid to exit passages 19 (referred to herein as high volume flushing outlets)—see FIG. 7*a*; the third cleaning mode is selected by allowing fluid to exit passages 154 (referred to herein as high pressure jetting passages)—see FIG. 7*a*.

The selection of the particular set of passages is accomplished by the rotation of the piston 155. For this, the different sets of passages are located at different locations around the main body 152 with respect to each other. Locating each set passages at locations (around the longitudinal axis of the main body 152) that differ from the location of the other set of passages allows selecting (by rotating the piston 155) the particular set of passages that will permit flow of the fluid out of the main body 152 for cleaning purposes. The remaining set of passages do not permit fluid flow out of the main body 152 because they are blocked by the wall of the piston 155.

The piston 155 is rotated due to the action of an actuator. The actuator comprises an electric motor 158. The actuator comprises an electric motor and gear box 158 with a cog 159 to engage with the gear in the underside of the piston 155 for rotating the piston 155.

Figure 8:
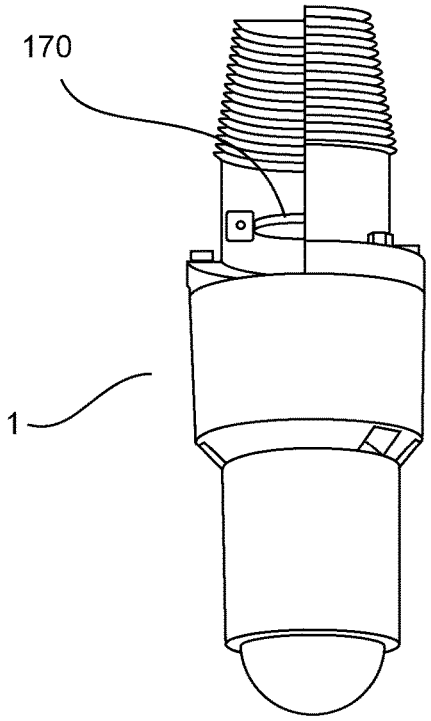
FIG. 8 is a perspective view of a survey tool in accordance with any one of the first to fifth embodiment of the invention incorporating a one way flap valve.

We refer now to FIG. 8. The survey tool 1 in accordance with the present embodiments of the invention may incorporate a one way flap valve 170. It is particularly advantageous that the survey tool 19 comprises the flap valve 170 because it stops fluid from the borehole flowing onto the drilling rig. In alternative arrangements there may be provided a one way flap valve pup attached between the drill string and the survey tool to avoid fluid from flowing into the drilling rig.

Figure 9:
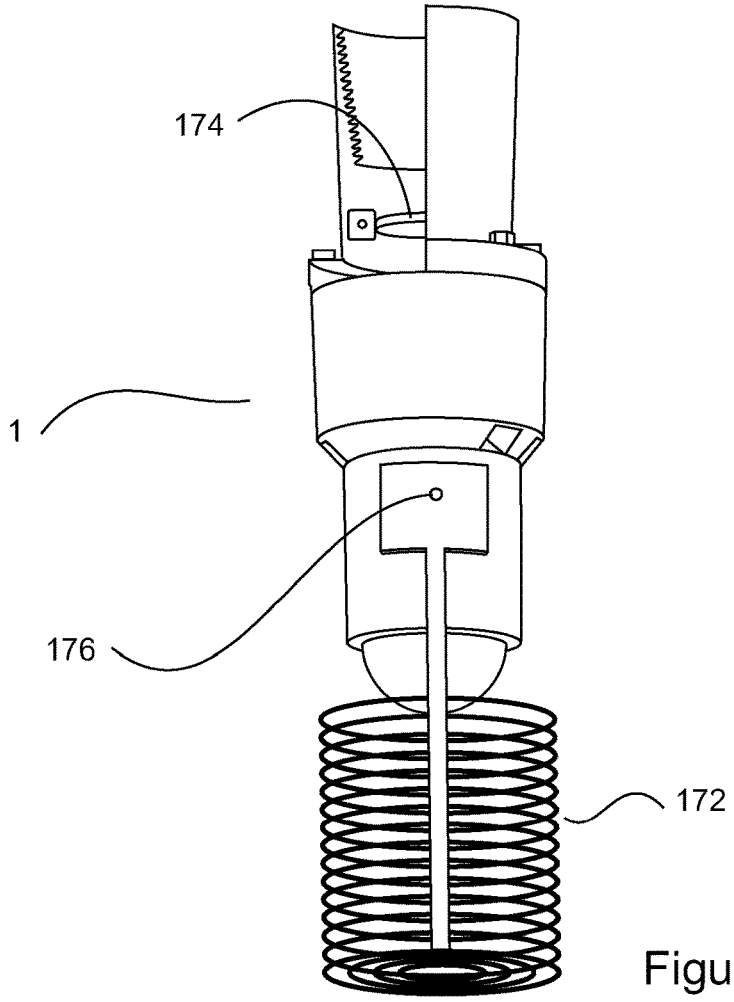
FIG. 9 is a perspective view of a survey tool shown in accordance with any one of the first to fifth embodiment of the invention incorporating a debris collecting basket.

We refer now to FIG. 9. The survey tool 1 in accordance with the present embodiments of the invention may incorporate a basket 172 for receiving and collecting any debris stopping the debris from falling into the well. The cleaning process and viewing process may be still operated while the basket 172 is attached to the survey tool 1. In the particular arrangement shown in FIG. 9 the basket is attached via one or more brackets 176.

Modifications and variations as would be apparent to a skilled addressee are deemed to be within the scope of the present invention.

Further, it should be appreciated that the scope of the invention is not limited to the scope of the embodiments disclosed. For example, the above descriptions have been described in relation to a downhole survey tool for use in a well. However, the present survey tool 1 may be used for any type of drilling operation may it be vertical, horizontal or directional drilling. In the embodiments of the invention related to horizontal and direction drilling the terms "proximal" and "distal" may be (respectively) more appropriate than the terms "upper" and "lower" used in the previous descriptions. The terms "upper" and "lower" are used in the previous description in view that the first to fifth embodiments of the invention relate to downhole survey tools for use in a well. However, the scope of the present of the invention is not limited to vertical drilling process.

Throughout this specification, unless the context requires otherwise, the word "comprise" or variations such as "comprises" or "comprising", will be understood to imply the inclusion of a stated integer or group of integers but not the exclusion of any other integer or group of integers.

| | |
|---|---|
| 1, | complete unit |
| 2, | is the main body |
| 3, | the first divisional chamber wall |
| 4, | aligning shoulders on the main body |
| 5, | main body shoulder wall |
| 6, | threaded bolt holes |
| 7, | grub screw on main body |
| 8, | shoulder seals on the camera housing |
| 9, | threaded holes to receive battery cap |
| 10, | umbilical side port |
| 11, | camera grub screw |
| 12, | batteries |
| 13, | protective battery covers |
| 14, | camera |
| 15, | dc electric motor |
| 16, | spindle drive assemble |
| 17, | plastic protective sleeve |
| 18, | combination high pressure filter and nozzle's |
| 19, | high volume outlets |
| 20, | piston |
| 21, | the passage for the spindle shaft |
| 22, | grub screw on piston |
| 23, | screw passage |
| 24, | internal piston wall |
| 25, | external piston wall |
| 26, | beveled end lower end of piston |
| 27, | beveled end top of piston |
| 28, | external beveled end, lower end of the piston |
| 29, | cap |
| 30, | cap thread |
| 31, | aligning shoulders on cap |
| 32, | cap shoulder wall |
| 33, | upper inside cap wall |
| 34, | bolt holes |
| 35, | filter recesses |
| 36, | filter |
| 37, | circlip retainer |
| 38, | a passage for clean fluid to pass through |
| 39, | degree cleaning nozzle's |
| 40, | front jetting passages |
| 41, | a passage for water to pass through the nozzle's |
| 42, | camera retainer |
| 43, | water proofed connectors |

FIG. 1, 2

-continued

| | |
|---|---|
| 44, | cored |
| 45, | seals |
| 46, | 0 piston seal |
| 47, | lower seal within the housing sealing against the piston |
| 48, | bolt on cap seals |
| 49, 50, | internal seal on the spindle gear retaining cap |
| 51, | external seal on the spindle gear retaining cap |
| 52, | top flushing seal |
| 53, | bottom flushing seal |
| 54, | external piston seal |
| 55, | circuit board |
| 56, | umbilical cored |
| 57, | Transvers passages through plastic cover |
| 58, | spindle drive nut |
| 59, | lower housing valve body wall |
| 60, | second divisional chamber |
| 61, | spindle gear retaining cap |
| 62, | housing for the spindle dc electric motor |
| 63, | circlips |
| 64, | grub nuts |
| 65, | transvers high pressure jetting passages |
| 66, | high pressure longitudinal jetting passage's |
| 67, | transvers jetting nozzle outlets can be at least one drilled hole or a thread to accept a screw in nozzle |
| 68, | drill string |
| 69, | battery cap |
| 70, | water proofed connector |
| 71, | battery cap side wall seal arrangement |
| 72, | battery cap holes |
| 73, | camera retaining housing |
| 74, | camera retaining passages |
| 75, | camera housing retaining grub screw |
| 76, | camera protector |
| 77, | camera lens |
| 78, | body of the camera |
| 79, | water proofed lens |

FIG 1, 2

| | |
|---|---|
| 80, | internal pump hollow piston |
| 81, | internal piston wall |
| 82, | upper outer piston wall |
| 83, | lower outer piston wall |
| 84, | piston retainer groves |
| 85, | top DC motor piston passages |
| 86, | hydraulic piston troth |
| 87, | bottom DC motor piston passages |
| 88, | extended lower hydraulic passage |
| 89, | internal bevel on the bottom of piston |
| 90, | external bevel on the bottom of piston |
| 91, | external upper bevel |
| 92, | piston chamber wall |
| 93, | alignment shoulder |
| 94, | housing bolt holes |
| 95, | lower piston chamber |
| 96, | upper piston chamber |
| 97, | lower piston chamber troth |
| 98, | top piston retainer |
| 99, | outer piston retainer seal |
| 100, | inner piston retainer seal |
| 101, | piston retainer shoulder |
| 102, | outer piston wall |
| 103, | retainer piston bolt holes |
| 104, | DC electric hydraulic motor |
| 105, | internal hydraulic fastening bolts |
| 106, | an oil filled cable and connector |
| 107, | water proof fitting |

FIG. 4

| | |
|---|---|
| 108, | drill string |
| 109, | piston |
| 110, | seal on the piston |
| 111, | Hydraulic motor |
| 112, | upper piston chamber hydraulic transverse passage |
| 113, | longitudinal hydraulic passage |
| 114, | a hydraulic tube running into the hydraulic motor |
| 115, | lower piston chamber hydraulic transverse passage |
| 116, | longitudinal hydraulic passage |
| 117, | a hydraulic tube running into the hydraulic motor |
| 118, | Oil filled cable and connector |

-continued

FIG. 5

| | |
|---|---|
| 119, | main body |
| 120, | cap accepting thread on main body |
| 121, | main body inside wall |
| 122, | main body shoulder |
| 123, | transverse jetting nozzle outlets |
| 124, | cap seal |
| 125, | outer seal on piston passage |
| 126, | inner seal on piston passage |
| 127, | top seal of high volume outlet |
| 128, | bottom seal of high volume outlet |
| 129, | multigate valve piston |
| 130, | outer piston wall |
| 131, | inner piston wall |
| 132, | base of the piston |
| 133, | threaded gear nut assembly |
| 134, | gear spindle passage |
| 135, | bevel on the lower end of the piston |
| 136, | high pressure outlet |
| 137, | transverse pressure outlet |
| 138, | outer top piston seal |
| 139, | divisional passage |
| 140, | DC electric motor |
| 141, | spindle drive worm shaft |
| 142, | grub nut passage |
| 143, | grub screw |
| 144, | drill string mounting cap |
| 145, | lower outer cap thread |
| 146, | thread for attaching to the drill string |
| 147, | cap shoulder |
| 148, | inside cap passage |
| 149, | battery compartment |

FIG. 6

| | |
|---|---|
| 150, | main body |
| 151, | accepting thread on body for mounting cap |
| 152, | inside wall of valve body |
| 153, | shoulder on body |
| 154, | high pressure jetting nozzle |
| 155, | piston |
| 156, | outside wall of piston |
| 157, | transverse bore |
| 158, | Dc electric motor |
| 159, | motor cog |
| 160, | gear |
| 161, | cap |
| 162, | drill string thread |
| 163, | lower thread for mounting on cap |
| 164, | shoulder on cap |
| 165, | seal for cap |
| 166, | inner piston seal |
| 167, | outer piston seal |
| 168, | top high pressure outlet seal |
| 169, | lower seal |

FIG. 7

The invention claimed is:

1. A survey tool for attachment to a drill string for inserting the survey tool into a borehole, the survey tool comprising a body having a proximal end adapted to receive fluid from the drill string and a distal end for receiving survey equipment, a wall having an inner surface defining a first bore within the body and an exterior surface defining at least a portion of the exterior of the body, and a piston adapted to be displaced within the first bore, the wall comprising a plurality of passages extending between the bore and the exterior surface to allow communication between the exterior of the body and the first bore; wherein the piston is adapted to be selectively displaced between a first condition to permit the fluid to flow through at least one first passage of the plurality of passages for delivery of the fluid to a first location surrounding the survey tool, a second condition to permit the fluid to flow through at least one second passage of the plurality of passages for delivery of the fluid to a second location located forefront of the survey tool comprising an area of the borehole to be surveyed by the survey equipment, and a third location to permit the fluid to flow through at least one third passage of the plurality of passages for delivery of the fluid to the survey equipment located at the distal end of the survey tool.

2. A survey tool according to claim 1, wherein the piston comprises a second bore for receiving the fluid from the drill string.

3. A survey tool according to claim 2, wherein piston comprises a plurality of fourth passages allowing the fluid to flow, respectively, from the second bore to any one of the at least one first, second or third passages of the wall of the survey tool during movement of the piston between the first, second and third conditions.

4. A survey tool according to claim 1, wherein the piston is adapted to move along the longitudinal axis of the first bore between the first condition and the second condition.

5. A survey tool according to claim 1, wherein the piston is adapted to move along the longitudinal axis of the first bore between the first condition, the second condition and a third condition.

6. A survey tool according to claim 1, wherein the piston is adapted to be selectively moved along the longitudinal axis of the first bore between the first condition, the second condition and the third condition.

7. A survey tool according to claim 1, wherein the piston is adapted to be selectively rotated about the longitudinal axis of the first bore between the first condition, the second condition and the third condition.

8. A survey tool according to claim 1, wherein the at least one first passage comprises jetting passages, the at least one second passage comprises flushing outlets, and the at least one third passage comprises front jetting passages.

9. A survey tool according to claim 8, wherein the piston, when in the first condition, allows fluid exiting the housing through the jetting passages but blocks fluid from flowing through the front jetting passages and through the flushing outlets.

10. A survey tool according to claim 8, wherein the piston, when in the second condition, allows fluid exiting the housing through the flushing outlets but blocks fluid from flowing through the jetting passages and through the front jetting passages.

11. A survey tool according to claim 8, wherein the piston, when in the third location, allows fluid exiting the housing through the front jetting passages but blocks fluid from flowing through the flushing outlets and through the jetting passages.

12. A survey tool according to claim 8, wherein the jetting passages comprises filter nozzles for filtering of the fluid.

13. A survey tool according to claim 1, wherein the piston is operatively connected to at least one actuator for movement of the piston along the longitudinal axis of the body of the survey tool.

14. A survey tool according to claim 13 wherein the actuator comprises a piston chamber, the piston chamber having a lower chamber and an upper chamber, the lower and upper chamber being fluidly connected for selectively displacing the piston along the longitudinal axis of the body of the survey tool.

15. A survey tool according to claim 14 wherein the actuator comprises an electric motor comprising a spindle drive worm shaft operatively connected to the piston for movement of the piston along the longitudinal axis of the body of the survey tool.

16. A survey tool according to claim 13 wherein the actuator comprises an electric motor operatively connected to a distal end of the piston for selectively rotating the piston about the longitudinal axis of the body of the survey tool.

17. A survey tool according to claim 1, further comprising an outer sleeve comprising outlets being fluidly communicated with the plurality of passages of the body allowing passage of the fluid through the outlets of the outer sleeve.

18. A survey tool according to claim 1, wherein the survey equipment comprises a camera.

19. A survey tool according to claim 1, further comprising an electric energy source adapted to be electrically connected to electric motors and the survey equipment.

20. A survey tool according to claim 19 wherein the energy source comprises a battery adapted to be received by the body of the survey tool.

21. A survey tool according to claim 1, wherein the proximal end of the body of the survey tool comprises a one way flip flap valve.

22. A survey tool according to claim 1, wherein the distal end of the body of the survey tool comprises a basket adapted to collect debris.

23. A drill string comprising a survey tool for attachment to a drill string for inserting the survey tool into a borehole, the survey tool comprising a body having a proximal end adapted to receive fluid from the drill string and a distal end for receiving survey equipment, a wall having an inner surface defining a first bore within the body and an exterior surface defining at least a portion of the exterior of the body, and a piston adapted to be displaced within the first bore, the wall comprising a plurality of passages extending between the bore and the exterior surface to allow communication between the exterior of the body and the first bore; wherein the piston is adapted to be selectively displaced between a first condition to permit the fluid to flow through at least one first passage of the plurality of passages for delivery of the fluid to a first location surrounding the survey tool, a second condition to permit the fluid to flow through at least one second passage of the plurality of passages for delivery of the fluid to a second location located forefront of the survey tool comprising an area of the borehole to be surveyed by the survey equipment, and a third location to permit the fluid to flow through at least one third passage of the plurality of passages for delivery of the fluid to the survey equipment.

24. A downhole camera comprising a survey tool for attachment to a drill string for inserting the survey tool into a borehole, the survey tool comprising a body having a proximal end adapted to receive fluid from the drill string and a distal end for receiving survey equipment, a wall having an inner surface defining a first bore within the body and an exterior surface defining at least a portion of the exterior of the body, and a piston adapted to be displaced within the first bore, the wall comprising a plurality of passages extending between the bore and the exterior surface to allow communication between the exterior of the body and the first bore; wherein the piston is adapted to be selectively displaced between a first condition to permit the fluid to flow through at least one first passage of the plurality of passages for delivery of the fluid to a first location surrounding the survey tool, a second condition to permit the fluid to flow through at least one second passage of the plurality of passages for delivery of the fluid to a second location located forefront of the survey tool comprising an area of the borehole to be surveyed by the survey equipment, and a third location to permit the fluid to flow through at least one third passage of the plurality of passages for delivery of the fluid to the survey equipment.

* * * * *